US006367112B1

(12) United States Patent
Moskovich et al.

(10) Patent No.: US 6,367,112 B1
(45) **Date of Patent: *Apr. 9, 2002**

(54) TOOTHBRUSH HAVING CONTROLLED HEAD MOVEMENT

(75) Inventors: Robert Moskovich, East Brunswick, NJ (US); Eyal Eliav, NYC, NY (US); Eric Chan; Kyoungeun Ahn, both of New York, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/473,512

(22) Filed: Dec. 28, 1999

Related U.S. Application Data

(63) Continuation of application No. 09/302,138, filed on Apr. 29, 1999.

(51) Int. Cl.[7] ..... A46B 9/04

(52) U.S. Cl. ..... 15/167.1; 15/143.1; 16/110.1

(58) Field of Search ..... 15/167.1, 172, 15/144.1, 143.1; D9/104; 16/110.1, 421

(56) References Cited

U.S. PATENT DOCUMENTS

| | | | | |
|---|---|---|---|---|
| 4,308,762 | A | * | 1/1982 | Jannard |
| D389,312 | S | * | 1/1998 | Porter |
| 5,968,309 | A | * | 10/1999 | Tarr |
| 6,076,223 | A | * | 6/2000 | Dair et al. |
| 6,286,173 | B1 | * | 9/2001 | Briones |
| 6,292,973 | B1 | * | 9/2001 | Moskovich et al. |

* cited by examiner

*Primary Examiner*—Terrence R. Till
(74) *Attorney, Agent, or Firm*—Henry S. Goldfine

(57) ABSTRACT

The present invention relates to a toothbrush having a handle formed of interlocking opposed S-curved sections, the first being relatively rigid and the second relatively resiliently flexible, the opposed S-curved sections forming a generally elongated FIG. 8, having a transverse aperture within each segment of the FIG. 8, such that during brushing the user can manipulate the relatively rigid and resiliently flexible section to position the bristle bearing face of the toothbrush to conform to the arcuate configuration of the dentiture.

30 Claims, 7 Drawing Sheets

TOOTHBRUSH HAVING CONTROLLED HEAD MOVEMENT

This is a continuation of prior application U.S. Ser. No. 9/302,138 filed on Apr. 29, 1999, entiled TOOTHBRUSH HAVING CONTROLLED HEAD MOVEMENT, which co-pending prior application granted as U.S. Pat. No. 6,292, 973 B1 on Sep. 25, 2001 and is incorporated herein by reference.

FIELD OF THE INVENTION

The present invention relates to toothbrushes and in particular to toothbrushes whose head position can be manipulated by applying pressure to specific segments of the handle.

BACKGROUND OF THE INVENTION

Conventional toothbrushes comprise uniform tufts of bristles each having a first end which is held captive in and fixed to a brush head, and a second end which is free and which is used for brushing. The free ends of the various tufts present a surface envelope which is capable of slight deformation by the bristles bending when they come in contact with a surface to be brushed, but which is incapable of adequately matching a surface having a complex shape. Such a complex surface is present in the mouth, wherein the teeth generally lie in a "C" shaped curve within the upper and lower jaw, each row of teeth consequently having a convex outer curve and a concave inner curve.

In toothbrushing the desire of users to cause the bristles to conform to the teeth is expressed by the forceful application of the brush to adequately deform the bristles to the arcuate contours of the dentiture. Such forceful application of the brush against the teeth merely leads to excessive wear of the tooth surfaces and gums, without adequate conformation of the brush to the teeth to provide the desired cleaning.

Toothbrushes having a flexibly neck located between the brush head, containing the bristles, and the handle have been disclosed in the prior art to provide conformation of the brush to the contours of the dentiture. Examples of such flexibly neck toothbrushes include the toothbrushes disclosed in U.S. Pat. Nos. 759,490 and 4,520,526. U.S. Pat. No. 759,490 creates neck flexibility by interposing a flexibly resilient material between a rigid brush head and handle, which flexibly resilient material may be reinforced with a second such type of material. U.S. Pat. No. 4,520,526 creates neck flexibility by the alternatives of either removing part of the material from the top and bottom of the neck portion of the brush, or having an oval shaped hollow in the neck extending from one side to the other. Such flexibly resilient toothbrush necks permit the bristle head to yield relative to the handle when the user, whereby the danger of injury to the teeth and gums is reduced, applies excessive force. However, such flexure means do not allow the user the ability to control the contour of the brush head to the particular arch of the oral surface being brushed, to avoid the need to apply excessive force in the first instance.

U.S. Pat. No. 4,333,199 discloses a toothbrush whose head is pivotally mounted on a coiled spring above a recessed handle, such that the head is adapted to rotate and tilt as it is applied to the teeth. While such flexing action will allow the brush head to generally follow the arch of the oral surface being brushed, it provides no direct control by the user of the moving, tilting, and rotating action of the toothbrush head.

PCT International Application WO 89/10076, discloses a toothbrush having the capability of varying the angle between the brush head and the handle in order to position the brush head in parallel with a arcuate section of the dentiture. WO 89/10076 discloses a toothbrush having a handle pivotally connected to the head, wherein the handle is formed of a pair of spaced apart, rigid, upper and lower sides, which sides are pivotally linked together to be movable lengthwise relative to each other. Alternatively, the spaced apart, rigid, upper and lower sides may be connected by means of an elastic spacer layer, which will also allow them to be movable lengthwise relative to each other. Use of a such a pivotally connected handle and head, controlled by the lengthwise movement of the rigid sides of the toothbrush, to accurately control the position of the toothbrush head is difficult at best. Such lack of precise control is due to the fact that pivoting linkages, which lack rigidity or resistance will tend to move the head excessively; while, the alternative use of an elastic layer will limit the movement of the head proportional to the degree of elasticity therein.

There is a need in the art for a toothbrush, wherein the position of the toothbrush head can be more precisely controlled by the user, to position the head in conformity with the arcuate configuration of the dentiture.

SUMMARY OF THE INVENTION

The present invention encompasses a toothbrush comprised of an elongated handle formed of a relatively rigid, generally S-curved longitudinal backbone section, extending at one end into a relatively straight neck with a flattened head portion containing a plurality of bristle tufts extending therefrom and at the other end a broadened base; wherein, the generally S-curved longitudinal backbone is opposed by a corresponding generally S-curved section of a relatively resiliently flexible elastomeric material, such that the opposed S-curves form a generally elongate figure 8 having extending therethrough an upper and a lower aperture. During brushing of the teeth, the user can manipulate, i.e. apply pressure to, the upper relatively rigid S-curve backbone or to the opposed resiliently flexible elastomeric section, while simultaneously compressing an opposite rigid and/or elastomeric section, to position the bristle bearing toothbrush face in a controlled manner to conform to the arcuate configuration of the dentiture.

DETAILED DESCRIPTION OF THE INVENTION

Figure 1:
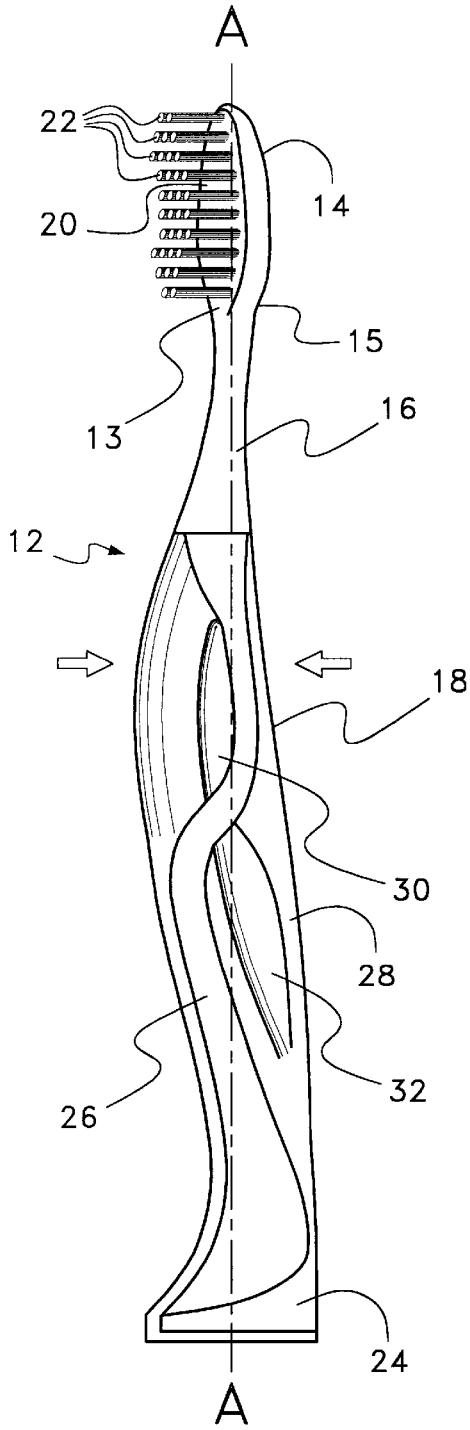
FIG. 1 is a longitudinal perspective view, showing the a first embodiment of the toothbrush of the present invention with an arbitrarily curved bristle pattern and a sufficiently clear elastomer about the handle and extending to the base of the neck, such that the S-curved relatively rigid backbone is visible.

Referring now to the drawings, wherein like reference numerals refer to the same or similar elements among the several figures, and in particular referring to FIG. 1; wherein there is shown a toothbrush, 12. FIG. 1 is a perspective view of a toothbrush of the present invention about a longitudinal axis A—A, with an upper side, 13, and a opposed lower side, 15, wherein the toothbrush has a head, 14, integral to and extending from a neck, 16, which neck is integral to and extending from a handle, 18, which handle is integral to an extending from a broadened base, 24. The head, 14, having a face, 20, on the upper side, 13, thereof; from which face extend rows of bristle tufts, 22, transverse to the longitudinal axis A—A.

Figure 1A:
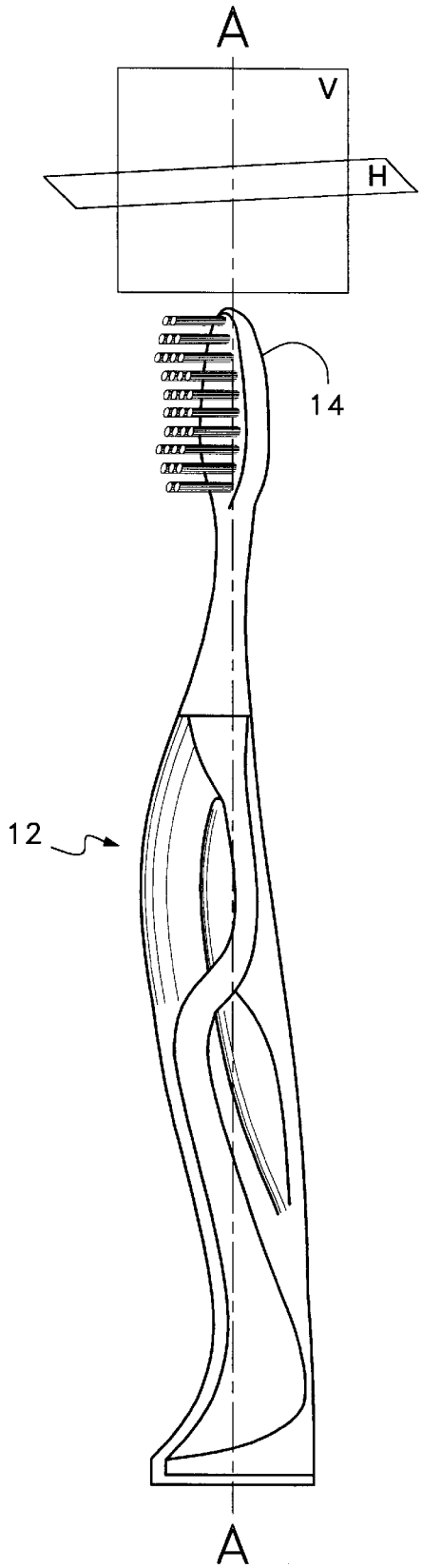
FIG. 1A is a perspective view of the toothbrush of FIG. 1, wherein a vertical plane and horizontal plane have been added; the vertical plane being perpendicular to the face of the toothbrush and through the longitudinal axis, A—A.

In accordance with the present invention, the head, 14, can flex relative to the handle, 18, in the vertical plane, identified as V in FIG. 1A; but, is substantially rigid relative to the handle in the horizontal plane, identified as H in FIG. 1. Such flexibility is due to the fact that the handle, 18, is multi-sectional, that is formed in sections of at least two materials having significantly different modulus of elasticity; one section being formed of a relatively rigid plastic and the other section being formed of a resiliently flexible elastomer. The relatively rigid plastic section comprises a generally S-curved longitudinal backbone, 26, extending from the neck of the toothbrush to the broadened base, 24, thereof. The resiliently flexible elastomeric section is also in the general shape of an S-curve, 28, and in opposed relation to the generally S-curved longitudinal backbone, 26, such that the opening of the generally S-curved rigid longitudinal backbone are closed by the generally S-curves of the resilient flexibly elastomeric section, 28.

Figure 8:
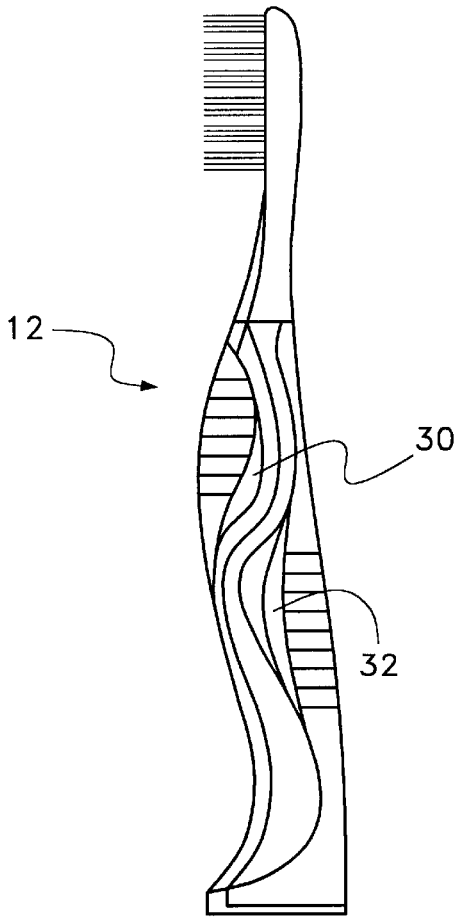
FIG. 8 is a cross-section side plan view, showing a seventh embodiment of the toothbrush of the present invention, with a typical flat bristle pattern.

Together, the S-curved rigid longitudinal backbone, 26 and opposed generally S-curved resilient flexibly elastomeric section, 28, form a generally elongated figure 8-shape. The interlocking S-curves that form the generally figure 8-shape handle define two aperture, an upper aperture, 30, more proximate to the neck, 16, and a lower aperture, 32, more proximate to the broadened base, 24; both apertures are preferably approximately equal in cross-section area.

The apertures, 30 and 32, are of sufficient cross-sectional area such that when the user applies a greater force to the relatively rigid backbone section, 26, about the upper aperture, 30, than to the opposed relative resiliently flexible section, 28, about the upper aperture, 30, or to the opposed relatively rigid backbone section about the lower aperture, 32, the connected bristle bearing head, 14, deflects to a position in the direction of the upper side, 13, of the toothbrush. The forces involved in this manipulation by the user are illustrated in FIG. 1 by the opposed arrows at an acute angle to the longitudinal axis A—A. Correspondingly, the user can apply a greater force, at an appropriate angle, to the relatively resiliently flexible section, 28, about the upper aperture, 30, than to the corresponding relatively rigid backbone, 26, about the upper aperture, 30, such that the bristle bearing head, 14, will deflect to a position in the opposite direction, i.e. away from the upper side, 13, of the toothbrush.

Figure 2:
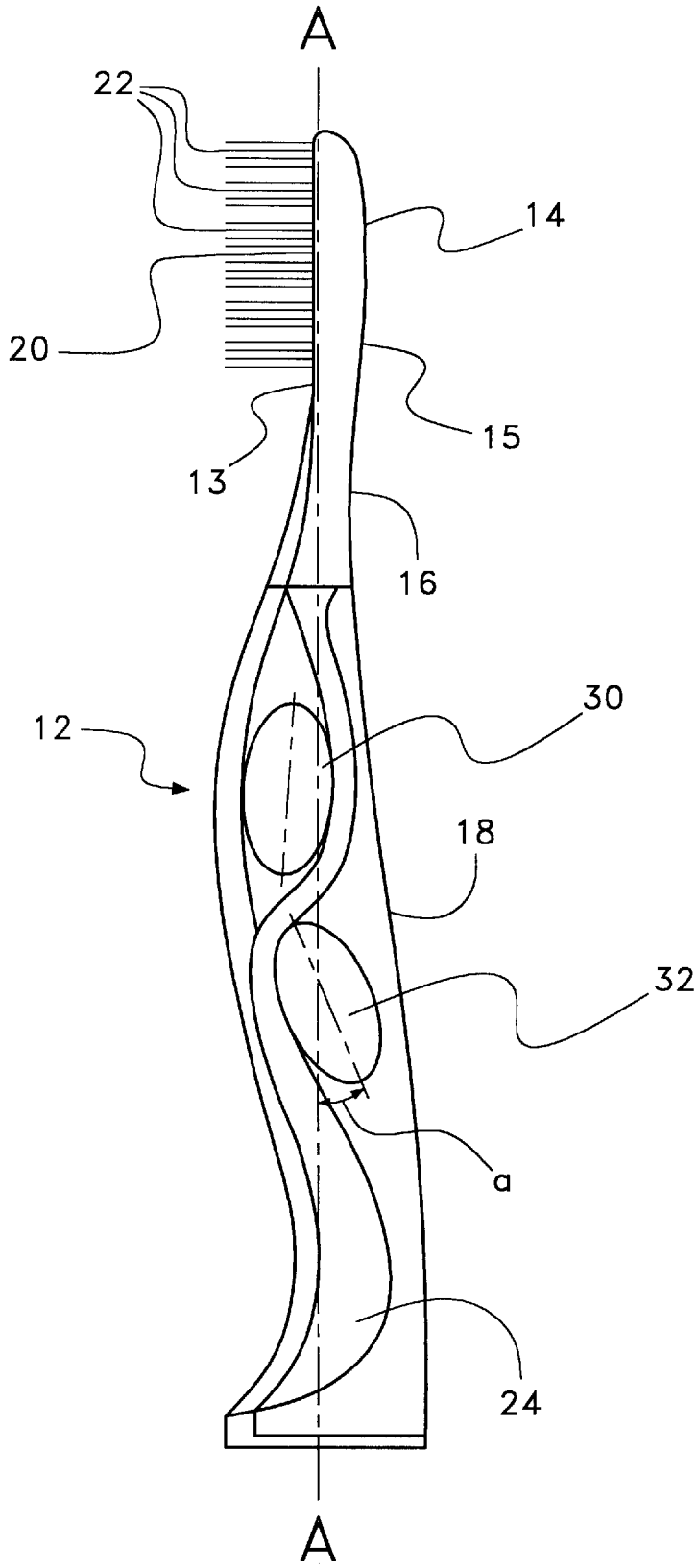
FIG. 2 is a cross-section side plan view, showing a second embodiment of the toothbrush of the present invention, with a typical flat bristle pattern and a broadened base.
Figure 3:
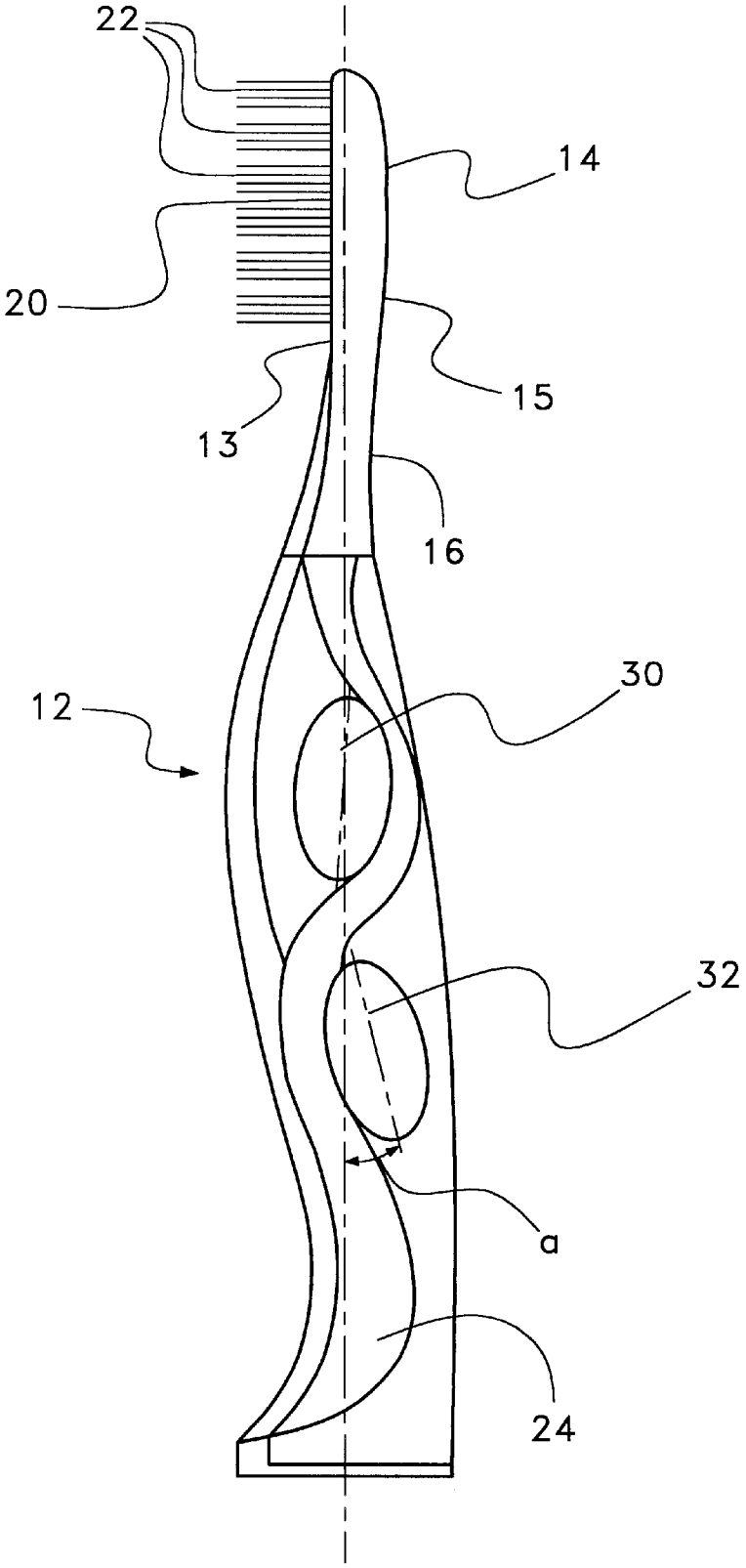
FIG. 3 is a cross-section side plan view, showing a third embodiment of the toothbrush of the present invention, with a typical flat bristle pattern and a broadened base.

The interlocking S-curve sections that form the handle are shown in FIG. 1 as being substantially equally spaced about the longitudinal axis A—A; however, in alternate embodiments of the present invention, the interlocking S-curves can be more forward of the longitudinal axis A—A, FIG. 2, or more behind the longitudinal axis A—A, FIG. 3. Further, while in FIG. 1 the apertures 30 and 32 are generally oval with a relatively narrow transverse axis in relationship to a longer longitudinal axis, which longer longitudinal axis may be aligned with or at an acute angle to the longitudinal axis A—A of the toothbrush; these apertures can be rounder, with much greater transverse axial length in relationship to their longitudinal axial length, such as shown in FIG. 2. Alternatively, the apertures, 30 and 32, can be crescent shaped as illustrated in FIG. 8.

In accordance with the present invention the head, 14, the neck, 16, the S-curved backbone, 26, and the broadened base, 24, are molded as an integral work-piece of relatively rigid polypropylene or other plastic with a similarly relatively rigid structure, such as a polyamide, i.e. nylon; or a polyester or a co-polyester, such as polyethylene terephthalate (PET), or a polycyclohexylene dimethylene terephthalate that is acid modified (PCTA); or a cellulosic plastic; or styrene acrylonitrile (SAN) or acrylonitrile butadiene styrene (ABS). The polypropylene or other rigid plastic is preferably of a Shore A Hardness ranging from 40 to 110, more preferably 60 to 110 and most preferably from 80 to 100. Suitable polypropylene is available from Huntsman Corporation, Longview, Tex., 75603 under the trade-designation Huntsman Polypropylene P4G3Z-039.

The relatively resiliently flexible elastomeric S-curve section, 28, may be molded of a variety of elastomeric materials, most especially thermoplastic elastomers (TPE). Acceptable TPE materials for the relatively resiliently flexible S-curved elastomeric section, 28, including styrene-ethylene/butylene-styrene (SEBS) Type styrene block copolymers, such as styrene-butadiene-styrene, styrene-isoprenestyrene, and related copolymers, as well as, thermoplastic polyurethane (TPU) or a thermoplastic vulcanate (TPV) which consists of a mixture of polypropylene and EPDM (ethylene propylene diene monomers) which is available as Santoprene (brand), described in U.S. Pat. No. 5,393,796; or Vyram (brand), another TPV consisting of a mixture of polypropylene and natural rubber, both Santoprene and Vyram being elastomers marketed by Advanced Elastomer Systems LP, Akron, Ohio 44311. Another, and preferred TPE is Dynaflex G6713 (brand), marketed by GLS Corp., Cary, Ill. 60013. These and other suitable elastomers have, typically, a Shore A hardness of from about 1 to 94, with about 15 to 60 being a preferred, and about 15 to 40 being most preferred.

Figure 4:
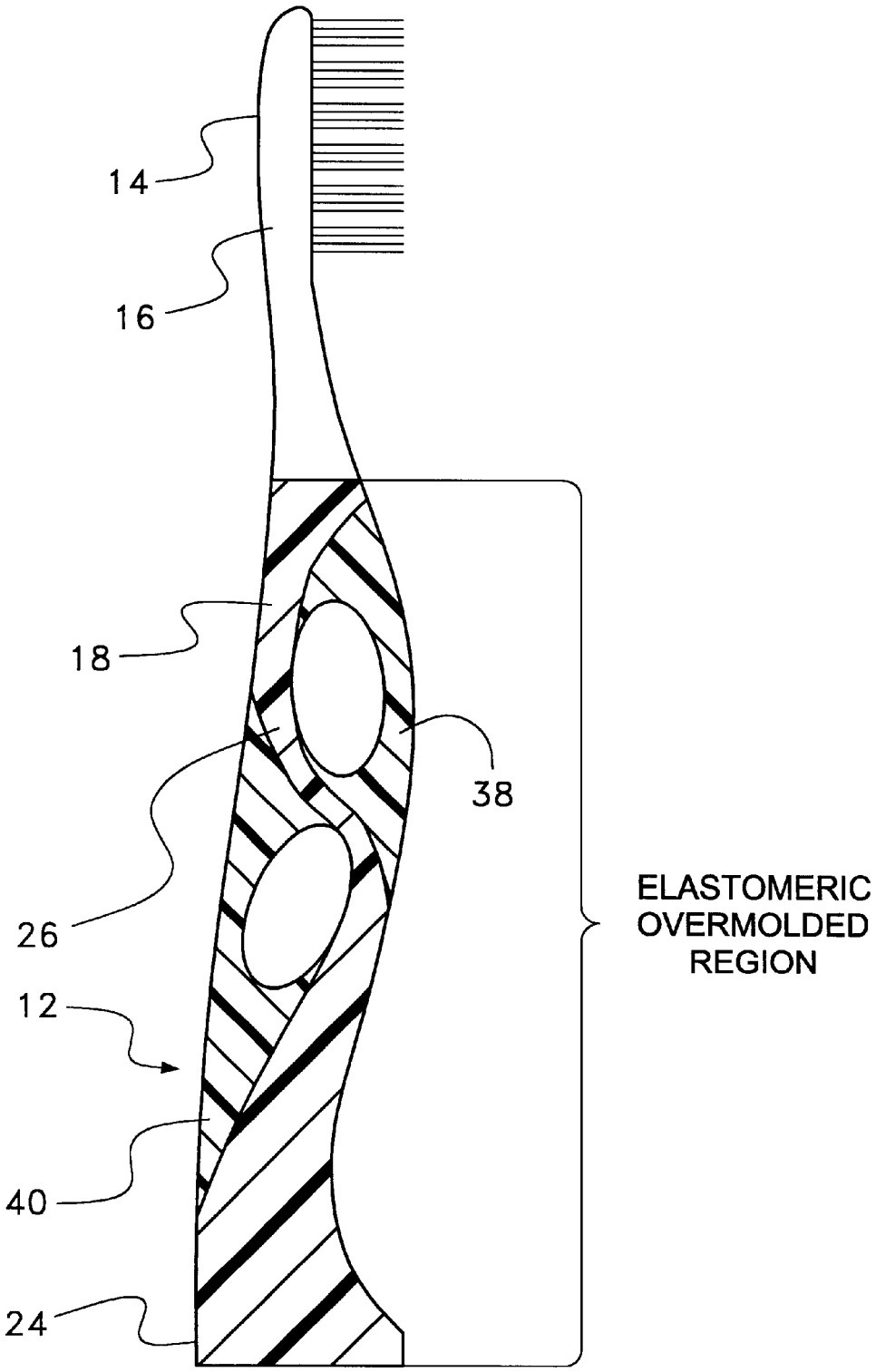
FIG. 4 is a cross-section side plan view, showing a fourth embodiment of the toothbrush of the present invention, with a typical flat bristle pattern.

The resiliently flexible elastomeric material can be overmolded about the handle, 18, as shown in FIG. 4, a cross-section view, as the elastomic overmolded region. The resiliently flexible elastomic S-curved section is shown in FIG. 4 as areas, 38 and 40, which are separated in the cross-section shown by the generally elongated S-curved relatively rigid backbone, 26. The degree of flexibility of both the relatively rigid backbone section, 26, and of the resiliently flexible elastomeric S-curve section, areas 38 and 40, can be further controlled by varying the thickness thereof, i.e. to provide more or less flexibility.

If a substantially clear appearance is desired for the relatively rigid components of the toothbrush, i.e. the toothbrush head, 14, the neck, 16, the relatively rigid generally S-curved backbone section, 26, and the broadened base, 24, can be of polyester, such as polyethylene terephthalate or a copolyester, such as PCTA polyester or SAN, or a cellulosic plastic, such as cellulose acetate propionate (CAP). If a substantially clear appearance is desired for the resiliently flexible elastomeric components of the toothbrush, i.e. the resiliently flexible S-curved elastomeric section, 28, certain TPE, or TPUS, or ethylene vinyl acetate (EVA) materials can be used. A preferred substantially clear TPE is available from Teknor Apex Company, Pawtucket, R.I. 02861, sold under the trade-designation 96-E0807A-03NT WAT CLR.

Figure 6:
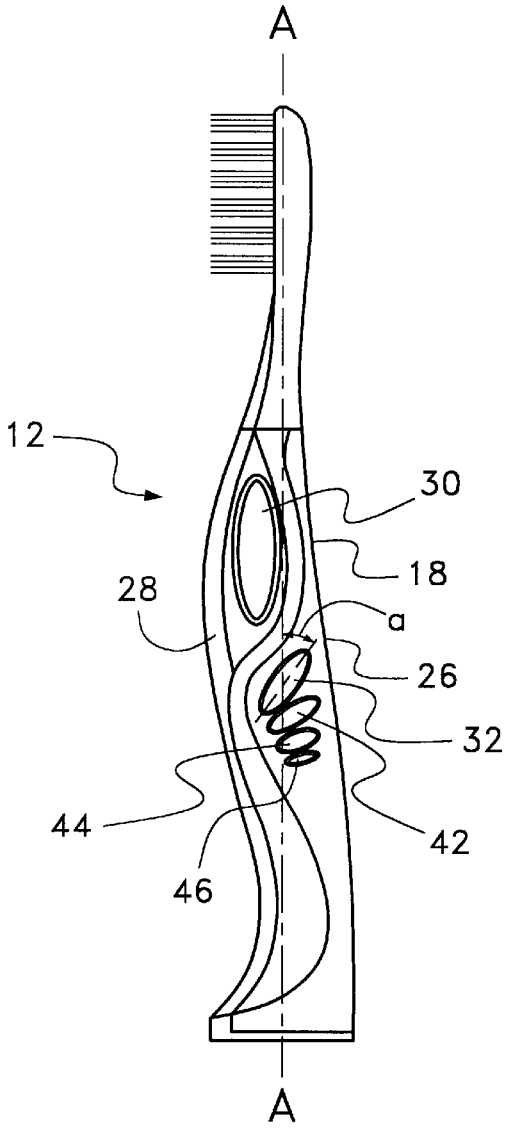
FIG. 6 is a cross-section side plan view, showing a fifth embodiment of the toothbrush of the present invention, with a typical flat bristle pattern.
Figure 7:
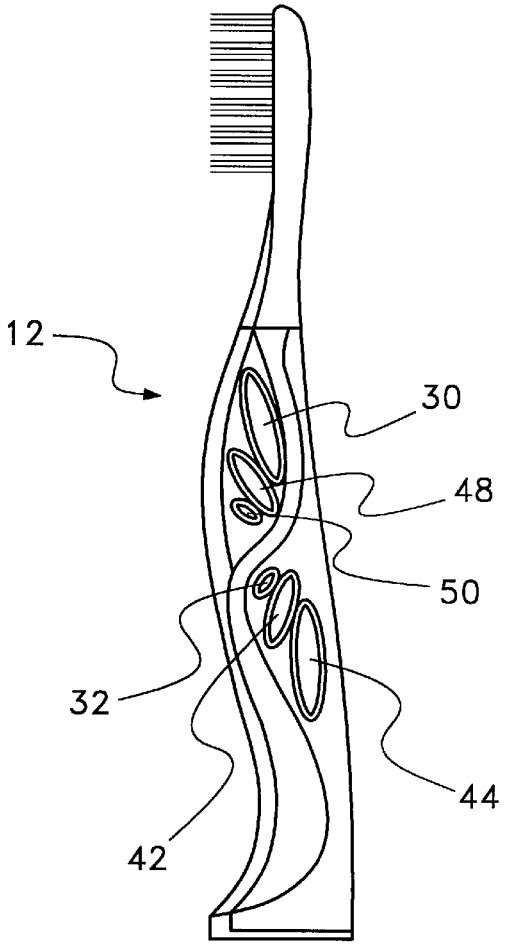
FIG. 7 is a cross-section side plan view, showing a sixth embodiment of the toothbrush of the present invention, with a typical flat bristle pattern.
Figure 9:
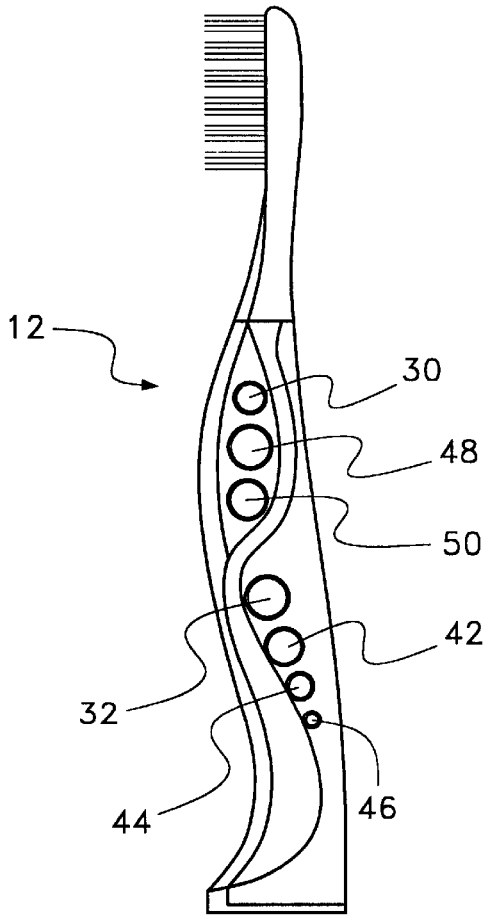
FIG. 9 is a cross-section side plan view, showing an eighth embodiment of the toothbrush of the present invention, with a typical flat bristle pattern.

Alternative embodiments of the present invention can contain within the upper and lower segments of the generally figure 8 shaped handle, 18, not only the two apertures previously discussed; but, also within each segment a single aperture or a grouping of a plurality of apertures, i.e. three, four, five or six apertures. In the case of either a single or such a grouping of apertures in the handle, 18, the relatively rigid backbone forms a first side of each aperture or grouping of apertures and a relatively resilient flexibly elastomer forms the second side of each aperture or grouping of apertures. The aperture(s), may be generally crescent, generally oval or generally round, with their longitudinal axis generally aligned with or at an acute angle to the longitudinal axis of the toothbrush A—A, as shown by angle "a" in FIGS. 2, 3 and 6. Such multiple apertures may all be located substantively about the longitudinal axis of the toothbrush, or on either side thereof. Illustrative illustrations of such alternative embodiments are shown in FIGS. 6, 7 and 9.

Figure 5:
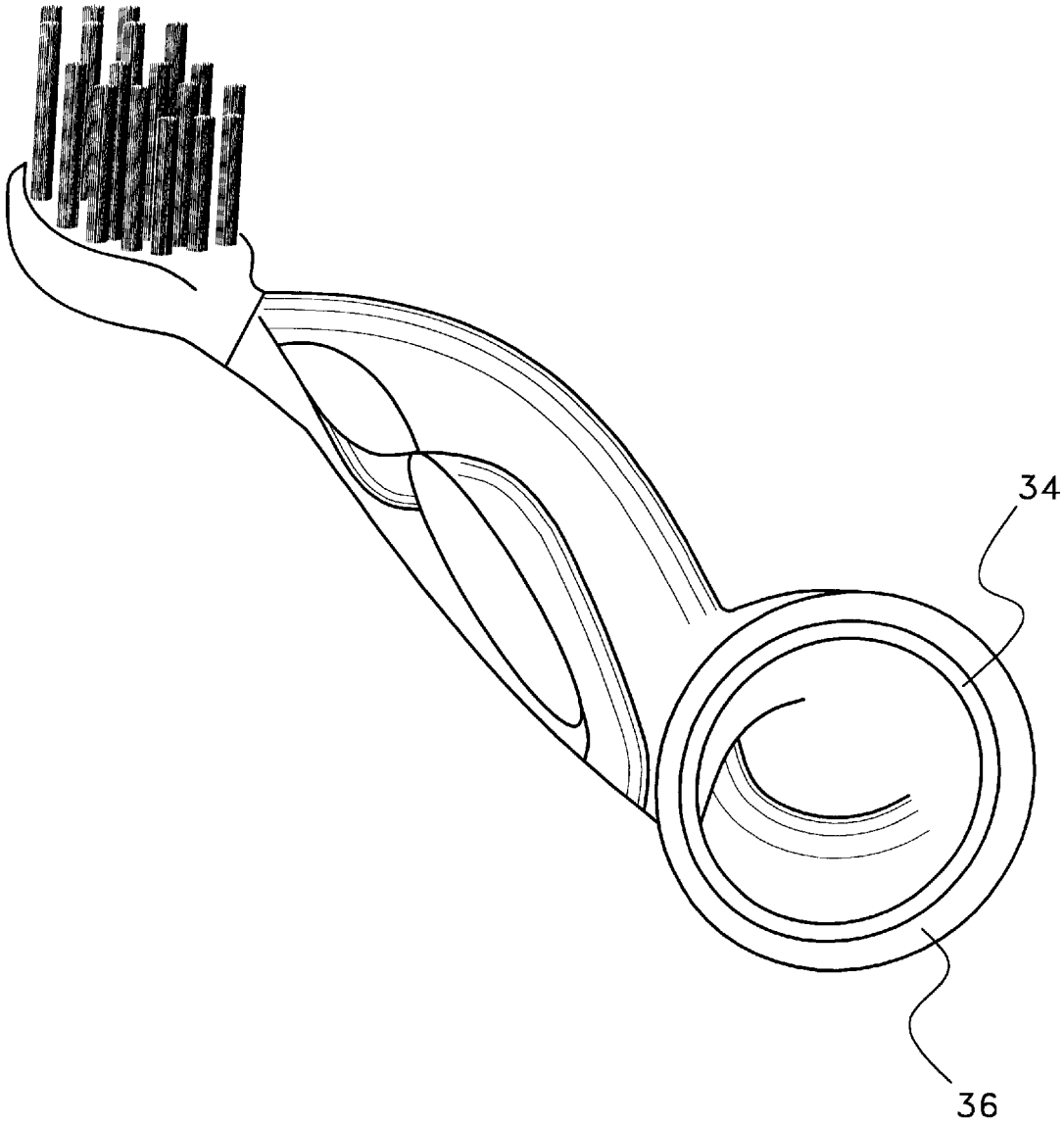
FIG. 5 is a perspective view of the toothbrush of FIG. 1, shown from the base and extending to the head thereof, with an arbitrary bristle pattern.

As the broadened base, 24, and the overall dual component construction of the present invention add significantly to the weight of a typical toothbrush, the base can be hollow to minimize the additional weight. As shown in FIG. 5, such a hollow base can be formed of an inner injection molded relatively rigid polypropylene shell, 34, surrounded by the resilient flexibly elastomeric material, 36 which comprises the resiliently flexible elastomeric material.

Multi-section component toothbrushes of the present invention can be molded by conventional injection molding technology, which is well known in the art. For example, in accordance with the present invention, the resiliently flexible elastomeric material section may be overmolded about the handle, 18, by a second injection step, after the first step of injection molding the frame or skeleton, which is comprised of the hard bristle implanting head, 14, neck, 16, relatively rigid handle backbone section, 26, and broadened base, 24. In this second injection step the frame is positioned in a second mold into which the resiliently flexible elastomeric material is injected about the handle, 18, thereof; more specifically, about the relatively rigid backbone section, 26, extending from the broadened base, 24, to the base of the neck, 16.

Facilitation of the two step injection molding of toothbrushes of the present invention can be by using a two component mold. Two component molds are available from numerous suppliers, including Machines Boucherie N.V., Izegem, Belgium; Anton Zahoransky GmbH & Company, Todtnau, Germany; or Braun Formenbau GmbH, Bahlingen, Germany; which molds can be mounted in typical injection molding machines for such implementing the two step injection process, such machines including 300 ton, two component injection molding machines available from Engel Vertriebsgesellschaft mbH, Schwertberg, Austria or Netstal-Maschinen AG, Nafels, Switzerland.

The toothbrush bristles may be implanted in the toothbrush face, 20, using either typical staple technology or using more modern non-staple technology as disclosed in U.S. Pat. Nos. 4,635,313, 4,637,660, 4,954,305, 5,045,267, 5,609,890, 5,390,984, 5,533791, and 5,823,633. Such non-staple technology involves processes wherein the bristle tufts, 22, are fused into the toothbrush head, 14, by heating both the bristle tufts, 22, and the toothbrush head, 14, which are then brought together in a fusion process; or, wherein the ends of the bristle tufts, 22, are pre-positioned in the injection mold prior to the introduction of the toothbrush material, which toothbrush material is subsequently injected about the ends of the bristle tufts, 22, locking the bristle tufts, 22, in place in the toothbrush head, 14.

What is claimed is:

1. A toothbrush having a user manipulatable head comprising:

said head having bristles extending therefrom; and an elongated handle having a longitudinal axis, an upper side and a lower side; which handle is comprised of a first relatively rigid, generally S-curved backbone section and an opposed second and resiliently flexible generally S-curved section; the opposed S-curve sections defining an elongated figure 8, having therethrough an upper aperture and a lower aperture.

2. The toothbrush according to claim 1, wherein the cross-sectional areas of the upper and lower apertures are generally equal.

3. The toothbrush according to claim 1, wherein the upper and lower apertures are generally oval in shape.

4. The toothbrush according to claim 1, wherein the upper and lower apertures are generally round in shape.

5. The toothbrush according to claim 1, wherein the upper and lower apertures are generally crescent shaped.

6. The toothbrush of claim 1, wherein the S-curved backbone has a Shore A Hardness ranging from 40 to 110.

7. The toothbrush of claim 1, wherein the relatively resiliently flexible generally S-curved section contains an elastomeric material.

8. The toothbrush of claim 7, wherein the elastomeric material has a Shore A hardness ranging from about 1 to about 94.

9. A toothbrush having a user manipulatable head comprising:

said head having bristles extending therefrom; and an elongated handle containing a relatively rigid backbone section and a resiliently flexible section with an aperture therebetween.

10. The toothbrush of claim 9, wherein the aperture is generally oval in shape, the longitudinal axis thereof being aligned at an acute angle with the longitudinal axis of the toothbrush.

11. The toothbrush of claim 9, wherein the aperture is generally round.

12. The toothbrush of claim 9, wherein the aperture is generally crescent shaped.

13. The toothbrush of claim 9, wherein the relatively rigid backbone section has a Shore A Hardness ranging from 40 to 110.

14. The toothbrush of claim 9, wherein the relatively resilient flexible section contains an elastomeric material.

15. The toothbrush of claim 14, wherein the elastomeric material has a Shore A hardness ranging from about 1 to about 94.

16. A toothbrush having a user manipulatable head comprising:

said head having bristles extending therefrom; and an elongated handle having a longitudinal axis and an upper side and a lower side which handle is comprised of a first relatively rigid, generally S-curved backbone section and an opposed second and relatively resiliently flexible generally S-curved section; the opposed S-curved sections defining an elongated figure 8 with an upper and lower segment, wherein one segment contains a single aperture and the other contains a plurality of apertures.

17. The toothbrush of claim 16, wherein there is at least one aperture which is oval in shape, the major axis thereof being aligned generally with the longitudinal axis of the toothbrush.

18. The toothbrush of claim 16, wherein there is at least one aperture which is oval in shape, the major axis thereof being aligned at an acute angle with the longitudinal axis of the toothbrush.

19. The toothbrush of claim 16, wherein there is at least one aperture which is generally round.

20. The toothbrush of claim 16, wherein the relatively rigid backbone section has a Shore A Hardness ranging from 40 to 110.

21. The toothbrush of claim 16, wherein the relatively resiliently flexible elastomeric section has a Shore A hardness ranging from about 1 to 94.

22. A toothbrush having a user manipulatable head comprising:

said head having bristles extending therefrom; and an elongated handle having a longitudinal axis and an upper side and a lower side which handle is comprised of a first relatively rigid, generally S-curved backbone section and an opposed second and relatively resiliently flexible generally S-curved section; the opposed S-curved sections defining an elongated figure 8 with an upper and lower segment, wherein each segment contains a plurality of apertures.

23. The toothbrush of claim 22, wherein the apertures are oval in shape, the major axis thereof being aligned generally with the longitudinal axis of the toothbrush.

24. The toothbrush of claim 22, wherein the apertures are oval in shape, the major axis thereof being aligned at an acute angle with the longitudinal axis of the toothbrush.

25. The toothbrush of claim 22, wherein the relatively rigid backbone section has a Shore A Hardness ranging from 40 to 110.

26. The toothbrush of claim 22, wherein the relatively resiliently flexible elastomeric section has a Shore A hardness ranging from about 1 to 94.

27. A method of positioning a toothbrush head to conform to the configuration of the dentiture comprising:

molding a toothbrush with an elongated handle having a longitudinal axis, an upper and a lower side, which handle is comprised of a first relatively rigid, generally S-curved backbone section and an opposed second and resiliently flexible generally S-curved section; the opposed S-curve sections defining an elongated figure 8, having therethrough an upper aperture and a lower aperture; positioning the head of the toothbrush by applying pressure to the first relatively rigid S-curved section about the upper aperture, while simultaneously compressing the there-opposed second relatively resiliently flexible S-curved section;

said head having bristles extending therefrom.

28. The method of positioning a toothbrush head according to claim 27, wherein rather than simultaneously compressing the there-opposed second relatively resiliently flexible S-curved section, the opposed first relatively rigid S-curved section about the lower aperture is compressed.

29. A method of positioning a toothbrush head to conform to the configuration of the dentiture comprising:

molding a toothbrush with an elongated handle having a longitudinal axis, an upper and a lower side, which handle is contains a relatively rigid backbone section which defines a first side of an aperture and opposed thereto a resiliently flexible section which defines a second side of said aperture; positioning the head of the toothbrush by applying pressure to the first relatively rigid backbone section, while simultaneously compressing the there-opposed second relatively resiliently flexible section;

said head having bristles extending therefrom.

30. A toothbrush having a user manipulatable head comprising:

said head having bristles extending therefrom; and an elongated handle containing a relatively rigid backbone section and a resiliently flexible section containing an elastomeric material, with an aperture between said relatively rigid backbone section and said relatively resiliently flexible section.

* * * * *